US008402614B2

(12) United States Patent
Fujii

(10) Patent No.: US 8,402,614 B2
(45) Date of Patent: Mar. 26, 2013

(54) SEPARABLE BOTTOM END STOP FOR SLIDE FASTENER

(75) Inventor: Takaaki Fujii, Toyama (JP)

(73) Assignee: YKK Corporation (JP)

( * ) Notice: Subject to any disclaimer, the term of this patent is extended or adjusted under 35 U.S.C. 154(b) by 197 days.

(21) Appl. No.: 13/119,496

(22) PCT Filed: Dec. 12, 2008

(86) PCT No.: PCT/JP2008/072694
§ 371 (c)(1),
(2), (4) Date: Mar. 17, 2011

(87) PCT Pub. No.: WO2010/067459
PCT Pub. Date: Jun. 17, 2010

(65) Prior Publication Data

US 2011/0191989 A1 Aug. 11, 2011

(51) Int. Cl.
*A44B 19/38* (2006.01)

(52) U.S. Cl. ..... 24/433

(58) Field of Classification Search ..... 24/386, 24/418–425, 433–436
See application file for complete search history.

(56) References Cited

U.S. PATENT DOCUMENTS

| | | | | |
|---|---|---|---|---|
| 7,694,396 | B2 * | 4/2010 | Ogura | 24/433 |
| 2002/0050031 | A1 | 5/2002 | Takasawa et al. | |
| 2006/0282998 | A1 | 12/2006 | Kusayama et al. | |
| 2008/0092347 | A1 | 4/2008 | Ogura | |

FOREIGN PATENT DOCUMENTS

| | | | |
|---|---|---|---|
| JP | 2002-136309 | A | 5/2002 |
| JP | 2006-346364 | A | 12/2006 |
| JP | 2008-99975 | A | 5/2008 |

OTHER PUBLICATIONS

International Search Report, PCT Application No. PCT/JP08/072694, mailed Mar. 24, 2009.

* cited by examiner

*Primary Examiner* — James Brittain
(74) *Attorney, Agent, or Firm* — Kilpatrick Townsend & Stockton LLP

(57) ABSTRACT

A separable bottom end stop in which a box pin has a box pin body, a first notch portion for receiving the head end of a locking pawl of a reverse-opening slider, and a protrusion piece projecting toward a separable pin in the direction of the tape width from a separable pin facing surface opposed to the separable pin. A side wall surface of the first notch portion and that sectional surface of the protrusion piece which is provided to the front end side of the box pin are formed in one plane to constitute a locking plane with which the front end of the locking pawl makes contact to lock the reverse-opening slider. The box pin body and the protrusion piece have a slant surface declined from the position of the locking plane toward an element row.

4 Claims, 8 Drawing Sheets

SEPARABLE BOTTOM END STOP FOR SLIDE FASTENER

This application is a national stage application of PCT/JP2008/072694, which is incorporated herein by reference.

TECHNICAL FIELD

The invention relates to a separable bottom end stop for a slide fastener having a reverse-opening slider, a box pin, and a separable pin, and more particularly, to a reverse-opening separable bottom end stop using a slider having a locking pawl as a reverse-opening slider.

BACKGROUND ART

A slide fastener has been used as a connecting tool for carpets or artificial lawns, which are divided by unit size as well as an opening-closing tool for opening and closing an opening portion of a cloth or a bag. Although a type of a slide fastener which can be opened or closed from the one end side toward the other end side in the length direction of element rows is generally used, there is, for example, a two-side-opening type slide fastener which can be opened from two end sides in the length direction of the element rows or a type of slide fastener which can be closed from the two end sides of the element rows.

For example, in the case of the two-side-opening type slide fastener, two sliders, that is, an opening slider and a reverse-opening slider are disposed in element rows of a fastener chain, each of the box pin and the separable pin is attached to one end of each of the left and right element rows. Therefore, the separable bottom end stop capable of performing reverse opening of the slide fastener is configured with the reverse-opening slider which passes through the element rows, the box pin, and the separable pin. In addition, in the hereinafter description, the separable bottom end stop capable of performing the reverse opening is simply referred to as a reverse-opening separable bottom end stop.

In general, many of the reverse-opening separable bottom end stops are configured so that the box pin is inserted into a right side element guide lane of the reverse-opening slider and the separable pin is inserted into a left side element guide lane of the reverse-opening slider, for example, as the reverse-opening slider is seen from the front side in the state where a connecting post of the reverse-opening slider is directed downwards in the vertical direction.

In addition, for example, in the case where the slide fastener is used with an arbitrary particular method or in a specific area of a foreign nation, unlike the general reverse-opening separable bottom end stop described above, a reverse-opening separable bottom end stop may be configured so that the insertion positions of the box pin and the separable pin are reversed in the left-right direction with respect to the reverse-opening slider and so that the box pin is inserted into the left side element guide lane of the reverse-opening slider and the separable pin is inserted into the right side element guide lane of the reverse-opening slider.

In addition, hereinafter, for clarifying the description, as the reverse-opening slider is seen from the front side in the state where the connecting post of the reverse-opening slider is directed downwards in the vertical direction, the reverse-opening separable bottom end stop where the separable pin is inserted into the left side element guide lane of the reverse-opening slider (in other words, the reverse-opening separable bottom end stop where the separable pin is inserted from the right side of the reverse-opening slider in the case where the slide fastener is attached to the front part of a cloth as seen from a user wearing the cloth) is defined by a right insertion type reverse-opening separable bottom end stop. In addition, the reverse-opening separable bottom end stop where the separable pin is inserted into the right side element guide lane of the reverse-opening slider (for example, the reverse-opening separable bottom end stop where the separable pin is inserted from the left side of the reverse-opening slider as seen from the user) is defined by a left insertion type reverse-opening separable bottom end stop.

For example, Japanese Patent Application Laid-Open No. 2008-99975 (Patent Document 1) discloses a left insertion type reverse-opening separable bottom end stop.

As illustrated in FIG. 12, the reverse-opening separable bottom end stop 61 disclosed in Patent Document 1 includes a box pin 70 which is attached to one end of the element row 63 in the length direction thereof in the right side fastener stringer 62, a separable pin 80 which is attached to one end of the element row 63 in the length direction thereof in the left side fastener stringer 62, and a reverse-opening slider 90 which the box pin 70 and the separable pin 80 can be inserted into.

A typical slider which is conventionally and generally used is used as the reverse-opening slider 90 in order to prevent an increase in production cost. The left and right element rows 63 are configured to pass through the element guide lanes 91 in the slider, and a locking pawl 92 which can be engaged with the right side element row 63 is disposed.

By allowing the reverse-opening slider 90 to slide from the one end of each of the left and right element rows 63 to the other end thereof, in other words, by allowing the reverse-opening slider 90 to slide in the direction where the reverse-opening slider 90 is separated from the state of contacting with the box pin 70 and the separable pin 80, the coupled left and right element rows 63 can be separated.

In addition, the box pin 70 includes a box pin body 71, a hooking portion 72 which is formed in the front end portion of the box pin body 71 so as to expand in the inner side of the fastener tape in order to prevent the reverse-opening slider 90 from being detached from the element row 63, a first insertion piece 73 which protrudes from the separable pin facing surface of the box pin body 71 toward the side of the separable pin 80, a second insertion piece 74 which is disposed to be closer to the box pin front and side compared to the first insertion piece 73 so as to protrude from the separable pin facing surface, and a notch portion 75 which is notched from the separable pin facing surface toward an inner portion of the box pin body 71 at the position which is closer to the side of the element row 63 compared to the hooking portion 72.

The separable pin 80 includes a separable pin body 81, a first receiving portion 82 which is disposed to be concave-shaped from the box pin facing surface of the separable pin body 81 and which can receive the first insertion piece 73 of the box pin 70 when the separable pin 80 is inserted into the reverse-opening slider 90, a second receiving portion 83 which is disposed to be concave-shaped from the box pin facing surface at the position which is closer to the separable pin front end side compared to the first receiving portion 82 and which can receive the second insertion piece 74 of the box pin 70, and an engaging protrusion 84 which is configured in the element row side end portion of the separable pin body 81 to be engaged with the element 64 on the side of the box pin 70.

As described above, in the reverse-opening separable bottom end stop 61 disclosed in Patent Document 1, the notch portion 75 is formed in the box pin 70, so that the locking pawl 92 of the reverse-opening slider 90 can be received in the notch portion 75 when the reverse-opening slider 90 is slid to the box pin side end portion of the element row 63.

In addition, in the case where the locking pawl 92 of the slider 90 is received in the notch portion 75, the side wall surface of the notch portion 75 on the side of the element row 63 constitute a contact surface 76 which contacts with the front end portion of the locking pawl 92. Therefore, by contacting the front end portion of the locking pawl 92 with the contact surface 76, it is possible to prevent the reverse-opening slider 90 from be freely moved from the box pin side end portion without intentional sliding manipulation, so that it is possible to prevent the left and right element rows 63 from being unintentionally separated from each other.

Accordingly, for example, in a usage aspect of a product attached with a slide fastener having the reverse-opening separable bottom end stop 61, in the case where the reverse-opening separable bottom end stop 61 is disposed at the upper side of the product (for example, over pants which a ski player wears), the conventional reverse-opening separable bottom end stop 61 has a problem in that, during the usage of the product, the reverse-opening slider 90 is lifted down unintentionally in the separation direction of the element rows 63 due to its weight, and thus the left and right element rows 63 may be separated from each other. However, the reverse-opening separable bottom end stop 61 disclosed in Patent Document 1 can solve the problem. Patent Document 1: Japanese Patent Application Laid-Open No. 2008-99975

DISCLOSURE OF THE INVENTION

Problems to be Solved by the Invention

In the left insertion type reverse-opening separable bottom end stop 61 disclosed in Patent Document 1, as described above, in the case where the reverse-opening slider 90 is located at the box pin side end portion, the front end portion of the locking pawl 92 is allowed to contact with the contact surface 76, so that it is possible to prevent the reverse-opening slider 90 from freely moving along the element rows 63.

However, for example, in the case where the reverse-opening separable bottom end stop 61 is disposed at the upper side of the product, if the reverse-opening slider 90 is shaken during the usage of the product, the position of the locking pawl 92 of the reverse-opening slider 90 is relatively shifted with respect to the contact surface 76 so that it may move from the contact surface 76 to a gap between the box pin 70 and the separable pin 80. As a result, the reverse-opening separable bottom end stop 61 has a problem in that, since the moving of the reverse-opening slider 90 cannot be stopped by the contact surface 76, the reverse-opening slider 90 easily moves along the element row 63 due to its weight or the like, so that the left and right element rows 63 are automatically separated from each other.

In addition, in a general slide fastener, in the case of performing the sliding manipulation of the slider with the tab of the slide gripped, although the front end portion of the locking pawl can be lifted so as to be escaped from the element guide lane 91 by the function of the tab of the slider, the front end portion cannot be completely escaped from the element guide lane 91, but even a short portion thereof protrudes inside the element guide lane 91.

Accordingly, for example, in the left insertion type reverse-opening separable bottom end stop 61 disclosed in Patent Document 1, in the case where performing the sliding manipulation of the reverse-opening slider 90 toward the end portion on the side of the box pin 70, for example, with the tab gripped, since even a short portion of the front end portion of the locking pawl 92 protrudes inside the element guide lane 91, the front end portion of the locking pawl 92 may easily interfere with the box pin body 71 to be hooked.

In this manner, if the front end portion of the locking pawl 92 is hooked with the box pin body 71, the reverse-opening slider 90 is stopped at the hook position. In this case, if the reverse-opening slider 90 is not allowed to slightly return to a backward position and to be slid again to the end portion on the side of the box pin 70, the reverse-opening slider 90 cannot be moved to the box pin side end portion. Therefore, there is a disadvantage in that the manipulation of the reverse-opening slider 90 becomes complicated.

In addition, in the case of paying no attention to the problem that the front end portion of the locking pawl 92 is hooked with the box pin body 71 and, thus, the reverse-opening slider 90 is stopped during the usage, if the left and right element rows 63 are coupled with each other by an opening slider (not shown) without complete movement of the reverse-opening slider 90 to the position of the end portion on the side of the box pin 70, there is also a problem in that the element rows 63 are erroneously coupled with each other and the cleavage in the coupling may easily occur.

By taking into consideration the conventional problems, the invention is to provide a separable bottom end stop for a slide fastener capable of improving a manipulation ability of a reverse-opening slider at the time of manipulating the reverse-opening slider to be slid toward a box pin side end portion and a manipulation ability of a separable pin at the time of inserting the separable pin into the slider, and capable of securely preventing the reverse-opening slider from being freely slid from the box pin side end portion without intentional sliding manipulation, so that left and right element rows cannot be unintentionally separated from each other.

Means for Solving the Problems

In order to achieve the above object, a separable bottom end stop for a slide fastener provided by the invention includes, as a basic configuration: a separable pin which is integrally formed in one end of an element row of one fastener stringer of a pair of left and right fastener stringers where element rows are formed in facing tape side edge portions of left and right fastener tapes; a box pin which is integrally formed in one end of the element row of an other fastener stringer; and a reverse-opening slider which passes through the element rows, wherein the reverse-opening slider includes a locking pawl which can stop the reverse-opening slider with respect to the element rows on a side of an element guide lane which the box pin is inserted into, being most mainly characterized in that the box pin includes a box pin body, a first notch portion which is notched in a first surface of the box pin body from a side of a separable pin facing surface toward an inner portion of the box pin body so as to receive a front end portion of the locking pawl, protrusion piece which protrudes from the separable pin facing surface of the box pin body toward a side of the separable pin in a tape width direction, a side wall surface which is disposed to the first notch portion on a side of the element row and a sectional surface which is disposed to a box pin front end side of the protrusion piece are formed in one plane and constitute a locking plane which contacts with the front end portion of the locking pawl which is received in the first notch portion to stop the reverse-opening slider, and the box pin body and the protrusion piece are configured to have a slant surface which is downwardly slanted from a position of the locking plane toward the side of the element row on a tape surface side of the fastener tape so as to guide the locking pawl toward the first notch portion when the box pin is inserted into the reverse-opening slider.

Further, in the separable bottom end stop for the slide fastener according to the invention, it is preferable that the protrusion piece is disposed to a first surface side of the separable pin facing surface and a second notch portion is notched toward an inner portion of the separable pin in a box pin facing surface of the separable pin.

In addition, in the invention, it is preferable that the box pin includes an insertion piece which protrudes from the separable pin facing surface toward the side of the separable pin at a position which is closer to the element row compared to the protrusion piece of the separable pin facing surface; the separable pin includes a receiving concave portion on the box pin facing surface, in which the receiving concave portion receives the insertion piece when the separable pin is inserted into the reverse-opening slider; and a first surface of the insertion piece and the slant surface are formed to be continuous with each other.

Effects of the Invention

The separable bottom end stop for a slide fastener according to the invention includes a separable pin, a box pin, and a reverse-opening slider, wherein the reverse-opening slider includes a locking pawl on the side of the element guide lane which the box pin is inserted into. The box pin of the separable bottom end stop includes a box pin body, a first notch portion which is notched in a first surface of the box pin body from a separable pin facing surface side toward an inner portion of the box pin body to receive a front end portion of the locking pawl, and a protrusion piece which protrudes from the separable pin facing surface of the box pin body.

In addition, a side wall surface which is disposed to the first notch portion on the side of the element row and a sectional surface which is disposed to the box pin front end side of the protrusion piece are formed in one plane and constitute a locking plane which contacts with the front end portion of the locking pawl to stop the reverse-opening slider. Furthermore, the box pin body and the protrusion piece are configured to have a slant surface which is downwardly slanted from the position of the locking plane toward the side of the element row on the tape surface side of the fastener tape.

In the separable bottom end stop for a slide fastener according to the invention, when manipulating the reverse-opening slider to be slid toward the box pin side end portion, since the locking pawl of the reverse-opening slider is guided into the first notch portion through the slant surface which is formed in the box pin body and the protrusion piece, it is possible to prevent the front end portion of the locking pawl from being hooked with the box pin body, so that it is possible to smoothly and stably slide the reverse-opening slider. Therefore, it prevents the manipulation of the reverse-opening slider from being complicated, so that it is possible to improve the manipulation ability of the slider.

In addition, after the locking pawl is received in the first notch portion by sliding the reverse-opening slider to the box pin side end portion, the front end portion of the locking pawl becomes in contact with the locking plane of the box pin, so that it is possible to prevent the reverse-opening slider from being freely slid from the box pin side end portion.

In addition, in the separable bottom end stop according to the invention, the locking plane which contacts with the locking pawl is formed in the sectional surface which is formed in the box pin front end side of the protrusion piece as well as the side wall surface of the first notch portion, so that the locking plane is formed to be wider in the tape width direction than that of the conventional case. Therefore, for example, although the reverse-opening slider is shaken in the left-right direction after the locking pawl is received in the first notch portion, it is possible to prevent the position of the locking pawl end portion from being shifted from the contact surface. Accordingly, it is possible to securely prevent the reverse-opening slider from being freely slid without intentional sliding manipulation, so that it is possible to prevent the left and right element rows from being unintentionally separated from each other.

In the separable bottom end stop for a slide fastener according to the invention, the protrusion piece is disposed on the first surface side of the separable pin facing surface, and the second notch portion is notched in the box pin facing surface of the separable pin toward an inner portion of the separable pin. Therefore, although the protrusion piece which protrudes toward the side of the separable pin in the tape width direction is disposed on the separable pin facing surface of the box pin body, in the case where the separable pin is inserted into the reverse-opening slider, it is possible to smoothly insert the separable pin without interference with the protrusion piece of the box pin, so that it is possible to improve a manipulation ability of the separable pin.

In addition, in the separable bottom end stop according to the invention, the box pin includes an insertion piece, which protrudes from the separable pin facing surface toward the side of the separable pin, at a position which is closer to the side of the element row compared to the protrusion piece of the separable pin facing surface; the separable pin includes a receiving concave portion, which receives the insertion piece, in the box pin facing surface; and a first surface of the insertion piece and a slant surface are formed to be continuous with each other. Therefore, when manipulating the reverse-opening slider to be slid toward the box pin side end portion, since the locking pawl of the reverse-opening slider is guided from the portion where the insertion piece is formed toward the first notch portion, it is possible to more smoothly slide the reverse-opening slider, so that it is possible to further improve a manipulation ability of the slider.

DESCRIPTION OF REFERENCE SIGNS

Figure 1:
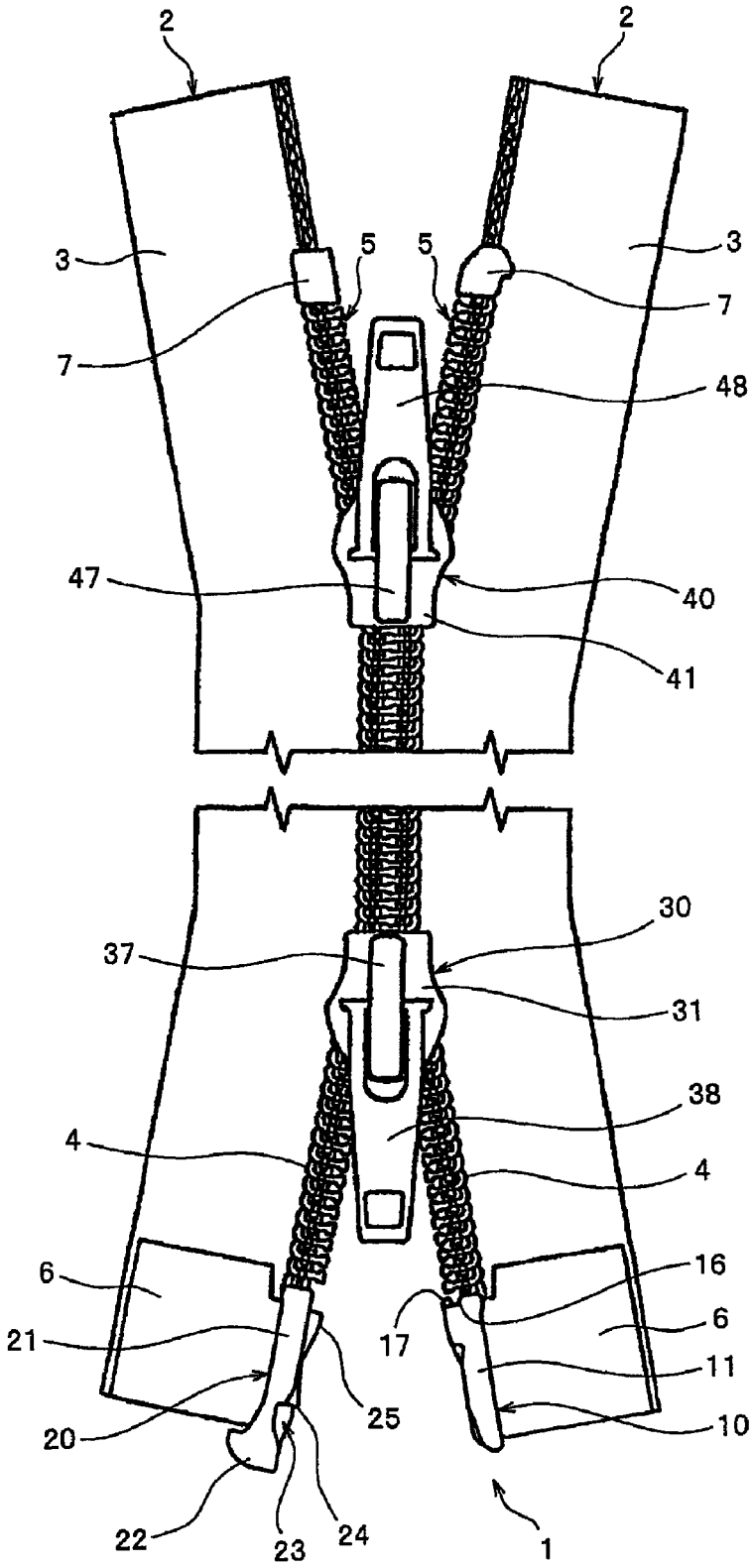
FIG. 1 is a front view illustrating a slide fastener having a left insertion type reverse-opening separable bottom end stop according to the invention.

1: separable bottom end stop
2: fastener stringer
3: fastener tape
4: element
5: element row
6: reinforcing portion
7: top stopper
10: separable pin
11: separable pin body
12: second notch portion
12*a*: bottom surface
12*b*: side wall surface
13: receiving concave portion
14: upper plate portion
15: lower plate portion
16: stepped portion
17: protrusion
18: box pin facing surface
20, 20': box pin
21, 21': box pin body
22: hooking portion
23, 23': first notch portion
23*a*: bottom surface
23*b*: first side wall surface
23*c*: second side wall surface
24, 24': protrusion piece
24*a*: sectional surface
25, 25': insertion piece
26: separable pin facing surface
27: locking plane
28, 28': slant surface
30: reverse-opening slider
31: upper blade
32: lower blade
33: connecting post
34 and 35: flange
36: locking pawl
37: tab attaching post
38: tab
39: element guide lane
40: opening slider
41: upper blade
42: lower blade
43: connecting post
44 and 45: flange
46: locking pawl
47: tab attaching post
48: tab
49: element guide lane

BEST MODE FOR CARRYING OUT THE INVENTION

Hereinafter, the preferred embodiments of the invention will be described in detail with reference to the drawings. In addition, the invention is not limited to the later-described embodiments, but various modifications can be made if substantially the same configuration as that of the invention is provided and the same function and effects as those of the invention are obtained.

For example, in hereinafter embodiments, element rows are formed by sewing coil-shaped elements to element attaching portions of left and right fastener tapes. However, the invention is not limited thereto, but the element rows may be formed by attaching a plurality of individual elements to the element attaching portions of the fastener tapes by injection molding a synthetic resin.

Figure 2:
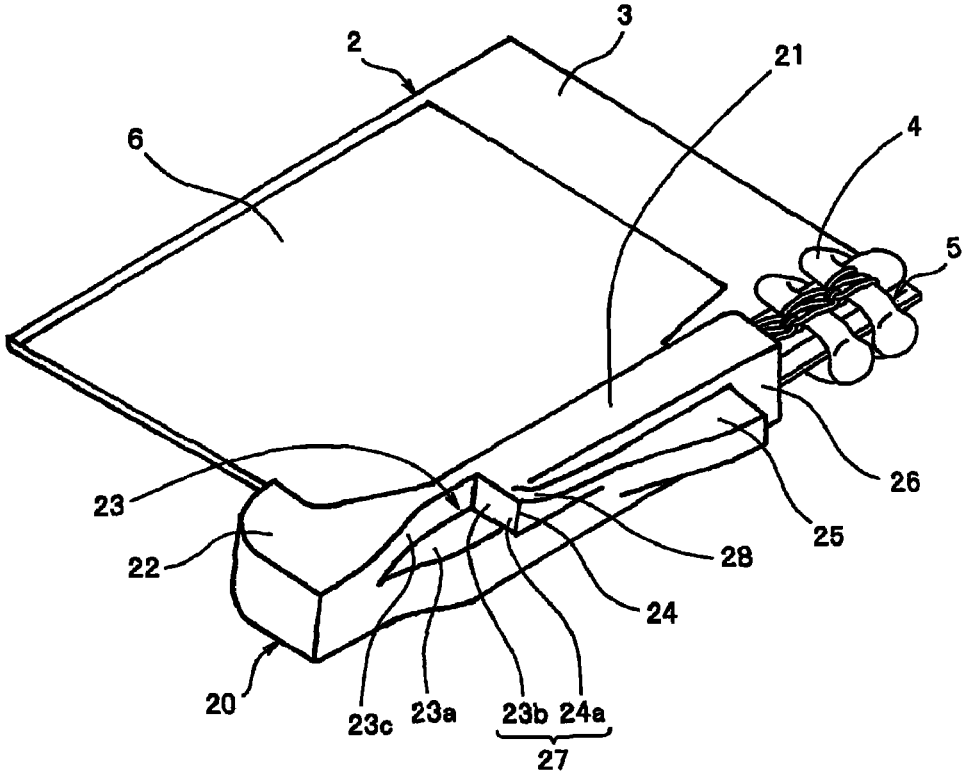
FIG. 2 is a main perspective view illustrating a box pin of the reverse-opening separable bottom end stop.
Figure 3:
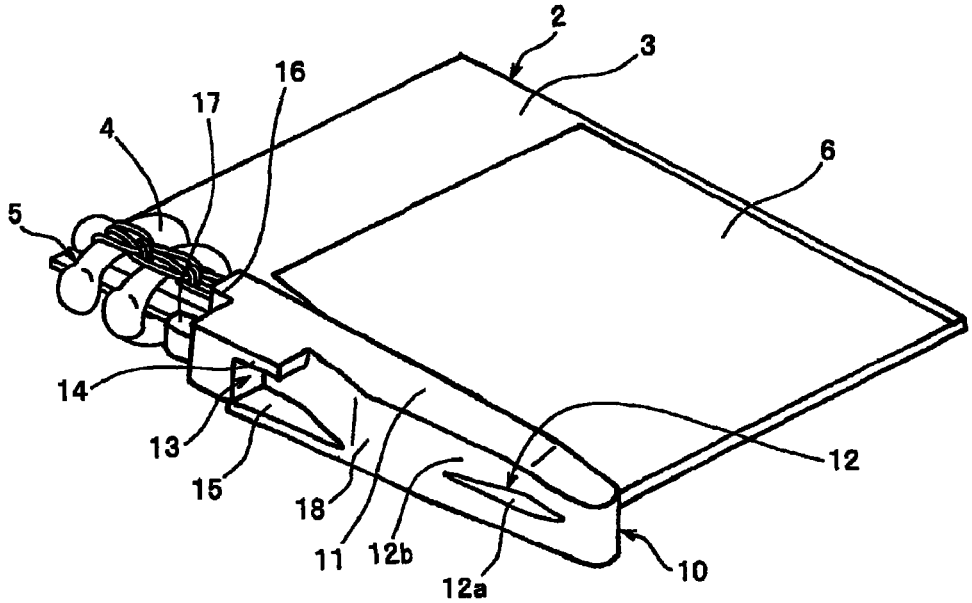
FIG. 3 is a main perspective view illustrating a separable pin of the reverse-opening separable bottom end stop.

Herein, FIG. 1 is a front view illustrating a slide fastener having a left insertion type reverse-opening separable bottom end stop according to the invention. FIG. 2 is a main perspective view illustrating a box pin of the reverse-opening separable bottom end stop, and FIG. 3 is a main perspective view illustrating a separable pin of the reverse-opening separable bottom end stop.

In addition, in the embodiment, the description is made as the following definition of directions. The longitudinal direction of the fastener stringer is defined as the forward-backward direction (the side in the element row where a top stopper is formed is defined as the forward direction and the opposite direction is defined as the backward direction); the tape width direction is defined in the left-right direction (as the figure is seen from the front, the left side is defined as the leftward direction and the right side is defined as the rightward direction); and the tape front-rear surface direction is defined as the up-down direction (as seen from the fastener tape, the side where the tab of the slider is disposed is the upward direction and the opposite direction is defined as the downward direction).

The separable bottom end stop 1 according to the embodiment is configured to include a separable pin 10 and a box pin 20 which is integrally molded with one end of each of the element rows 5 of a pair of left and right fastener stringers 2 and a reverse-opening slider 30 into which the separable pin 10 and the box pin 20 can be inserted.

In this case, the pair of left and right fastener stringers 2 include left and right the fastener tapes 3 each of which has a tape main part and a tape side edge portion, the element rows 5 which are constructed with coil-shaped elements 4 which are sewed to the facing tape side edge portions of the fastener tapes 3, reinforcing portions 6 each of which is formed in one end of each of the fastener tapes 3, the box pin 20 which is attached be continuous with the lower end of the element row 5 of the left-side fastener stringer 2, the separable pin 10 which is attached to be continuous with the lower end of the element row 5 of the right-side fastener stringer 2, and top stoppers 7 which are attached to upper ends of the element rows 5. In addition, the separable pin 10, the box pin 20, and the top stoppers 7 may be integrally molded to the tape side edge portions of the fastener tapes 3 by injection molding means using a thermoplastic resin such as polyester or polyamide.

In addition, a reverse-opening slider 30 and an opening slider 40 for coupling and separating left and right element rows 5 are slid along the element rows 5 to pass though the fastener stringers 2. For the reverse-opening slider 30 and the opening slider 40, conventionally and generally used sliders having the locking pawls 36 and 46 are used in order to reduce production costs.

In other words, each of the reverse-opening slider 30 and the opening slider 40 includes: upper and lower blades 31 and 32, 41 and 42; the connecting post 33, 43 which connects the upper and lower blades 31 and 32, 41 and 42 to the front end portion of the slider; left and right flanges 34 and 35, 44 and 45 which are formed at the left and right side edges of the upper blade 31, 41 and the lower blade 32, 42; locking pawl 36, 46 which is disposed on the upper blade 31, 41 to be allowed to stop the slider 30, 40 by engaging the front end portion thereof with the element rows 5; a tab attaching post 37, 47 which is disposed to erect on a surface of the upper blade 31, 41; and tab 38, 48 which is attached to the tab attaching post 37, 47.

In addition, shoulder openings are formed at the left and right sides of the connecting post 33, 43 in the end portions of the slider 30, 40 on the side where the connecting post 33, 43 is disposed, and a rear opening is formed in the end portion of the opposite side thereof. In addition, in the slider 30, 40, substantially Y-shaped element guide lanes 39, 49, as seen from the front side, which communicate the left and right shoulder openings with the rear opening are disposed. In addition, with respect to the element guide lanes 39, 49, at the width direction Center of the slider 30, 40 as a reference, the left side one is defined as a left side element guide lane 39, 49, and the right side one is defined as a right side element guide lane 39, 49.

In this manner, in the embodiment, the same type sliders are used for the reverse-opening slider 30 and the opening slider 40, and the opening slider 40 and the reverse-opening slider 30 are allowed to pass through the element rows 5 in the state where the opening slider 40 and the reverse-opening slider 30 are directed in the reverse directions so that the corresponding rear openings coincide with each other.

Therefore, in the opening slider 40, in order to easily engage the locking pawl 46 with the element rows 5, the locking pawl 46 is disposed to the right side element guide lane 49 where the separable pin 10 is inserted. On the other hand, in the reverse-opening slider 30, the locking pawl 36 is disposed to the left side element guide lane 39 where the box pin 20 is inserted.

In addition, in this case, for example, by sliding the opening slider 40 from the element row end portions on the side where the separable pin 10 and the box pin 20 are disposed toward the other element row end portions on the side where the top stoppers 7 are disposed, the left and right element rows 5 in the separated state can be coupled with each other. In addition, when left and right element rows 5 are partially coupled with each other, by sliding the reverse-opening slider 30 from the end portions on the side where the separable pin 10 and the box pin 20 are disposed toward the end portions on the side where the top stoppers 7 are disposed, the left and right element rows 5 can be separated from each other.

In the separable bottom end stop 1 according to the embodiment, as illustrated in FIG. 2, the box pin 20 includes a box pin body 21 having rectangular column shape which is fixed to the tape side edge portion of the left side fastener tape 3, a hooking portion 22 which is formed at the end portion (front end portion) of the box pin body 21 opposite to the side of the element row 5 so as to protrude toward the side of the tape main part of the fastener tape 3, a first notch portion 23 which is notched in the upper surface (first surface) of the box pin body 21 from the side of the separable pin facing surface 26 toward an inner portion of the box pin body 21, a protrusion piece 24 which protrudes from the separable pin facing surface 26 of the box pin body 21 toward the side of the separable pin 10 in the tape width direction, and an insertion piece 25 which protrudes from the separable pin facing surface 26 toward the side of the separable pin 10 at the position of the separable pin facing surface 26 where it is closer to the side of the element row 5 compared to the protrusion piece 24.

In the box pin 20, the hooking portion 22 is configured so as to stop the slider 30 from sliding and to prevent the slider 30 from being detached from the element rows 5 by allowing the flange 34 and 35 of the reverse-opening slider 30 to contact with the hooking portion 22 when the reverse-opening slider 30 is slid toward the box pin side end portion, The first notch portion 23 of the box pin 20 is formed to have a depth so as to receive the front end portion of the locking pawl 36 of the slider 30 when the reverse-opening slider 30 is slid to the box pin side end portion. The first notch portion 23 includes a bottom surface 23*a*, a first side wall surface 23*b* disposed on the side of the element row 5, and a second side wall surface 23*c* disposed on the side of the fastener tape 3. The bottom surface 23*a* is formed to be concave in a step shape from the first surface of the box pin body 21 through the first side wall surface 23*b* and the second side wall surface 23*c*. In addition, the bottom surface 23*a* is formed so that the dimension in the tape width direction is decreased from the side of first side wall surface 23*b* toward the front end of the box pin 20.

In addition, the first side wall surface 23*b* is disposed to be perpendicular to the length direction of the box pin body 21, and the second side wall surface 23*c* includes a curved surface portion which is continuous with the separable pin facing surface 26 of the box pin body 21 on the box pin front end side. In addition, the shape, the dimension, and the like of the first notch portion 23 can be arbitrarily modified according to the shape or the like of the box pin 20.

The protrusion piece 24 disposed on the upper surface side of the separable pin facing surface 26 as the box pin 20 is seen from the side of the separable pin facing surface 26. In addition, the protrusion piece 24 has a substantially triangular shape which protrudes from the box pin body 21 toward the side of the separable pin 10 as the box pin 20 is seen from the front side.

The sectional surface 24*a* which is disposed to the box pin front end side of the protrusion piece 24 and the first side wall surface 23*b* of the first notch portion 23 are formed to be in one plane. A locking plane 27 is constructed with the sectional surface 24*a* and the first side wall surface 23*b* of the first notch portion 23 so that the locking plane 27 contacts with the locking pawl end portion to stop the reverse-opening slider 30 from sliding when the front end portion of the locking pawl 36 is received in the first notch portion 23.

In other words, in the embodiment, since the locking plane 27 of the box pin 20 is constructed with the sectional surface 24*a* of the protrusion piece 24 and the first side wall surface 23*b* of the first notch portion 23, in comparison with the conventional separable bottom end stop disclosed in, for example, Patent Document 1, it is possible to secure a wide area of the locking plane, and it is possible to securely contact the front end portion of the locking pawl 36 of the reverse-opening slider 30 with the locking plane 27.

The insertion piece 25 of the box pin 20 is formed so as to protrude in a plate shape from the separable pin facing surface 26 toward the side of the separable pin 10 at a substantially central position in the up-down direction (height direction) of the box pin body 21 and to have a trapezoidal shape as the box pin 20 is seen from the front side. The dimension (thickness) of the insertion piece 25 in the up-down direction is not particularly limited, but it is preferable that the dimension is set to be ¼ or more or ½ or less of the thickness of the box pin body 21 by taking into consideration, for example, strength of the insertion piece 25 or the manipulation ability at the time of manipulating the box pin 20 and the separable pin 10.

In addition, in the protrusion piece 24 and a portion of the box pin body 21 on the side where the protrusion piece 24 is disposed, a slant surface 28 which is downwardly slanted from the height position of the upper surface (first surface) of the box pin body 21 on the tape surface side of the fastener tape 3 is formed from the position where the locking plane 27 is disposed toward the side of the element row 5 on the upper surface side. The slant surface 28 is formed so that, as it approaches the element row 5, the slope becomes low to be continuous with the upper surface of the insertion piece 25.

In this case, the height from the bottom surface 23*a* of the first notch portion 23 to the upper end edge of the first side wall surface 23*b* is set to be equal to the height from the bottom surface 23*a* to the upper end edge of the sectional surface 24*a* of the protrusion piece 24. In addition, the lower surface side of the protrusion piece 24 where the slant surface 28 is formed is formed in a plane parallel to the surface of the fastener element 3.

As illustrated in FIG. 3, the separable pin 10 according to the embodiment includes a separable pin body 11 which is attached to the tape side edge portion of the right side fastener tape 3, a second notch portion 12 which is formed in the box pin facing surface 18 of the front end portion of the separable pin body 11, a receiving concave portion 13 which is formed to be closer to the side of the element rows 5 compared to the second notch portion 12 of the box pin facing surface 18, a upper plate portion 14 and a lower plate portion 15 which are disposed on the upper surface side and the lower surface side of the receiving concave portion 13, a stepped portion 16 which is formed in the end portion of the separable pin body 11 on the side of the element row 5, and a protrusion 17 which protrudes from the sectional surface of the stepped portion 16 facing in the forward direction of the longitudinal direction of the fastener stringer 2 toward the element 4.

In the separable pin 10, the second notch portion 12 is formed in a partial area of the separable pin front end portion side from the side of the separable pin facing surface 26 toward an inner portion of the separable pin body 11. Therefore, in the case where the separable pin 10 is inserted into the reverse-opening slider 30 as described later, the second notch portion 12 constitutes an escape portion for preventing the separable pin 10 from colliding and interfering with the protrusion piece 24 which is formed in the box pin 20.

Since the second notch portion 12 is formed in the upper surface side of the separable pin body 11 so as to secure a strength of the separable pin body 11, the second notch portion 12 includes a bottom surface 12*a* and a side wall surface 12*b*. In this case, the bottom surface 12*a* is formed to be concave from the first surface of the separable pin body 11, and the side wall surface 12*b* is formed from the height position of the first surface to the height position of the bottom surface 12*a*. In other words, the second notch portion 12 is formed on the same upper surface side as that of the first notch portion 23 of the box pin 20.

In addition, in the separable pin body 11, since the portion which is disposed on the lower surface side lower than the bottom surface 12*a* of the second notch portion 12 passes through the space portion which is disposed on the lower surface side of the protrusion piece 24 of the box pin 20 when the separable pin 10 is inserted into the reverse-opening slider 30 (refer to FIG. 7), the lower surface side portion of the separable pin body 11 does not interfere with the protrusion piece 24 of the box pin 20. At this time, the side wall surface 12*b* of the second notch portion 12 passes through the right side of the protrusion piece 24. In addition, in the invention, in the case where a sufficient strength of the separable pin body 11 can be secured, the second notch portion 12 may be formed over the entire up-down directions of the separable pin body 11 as well as on the upper surface side of the separable pin body 11.

Figure 10:
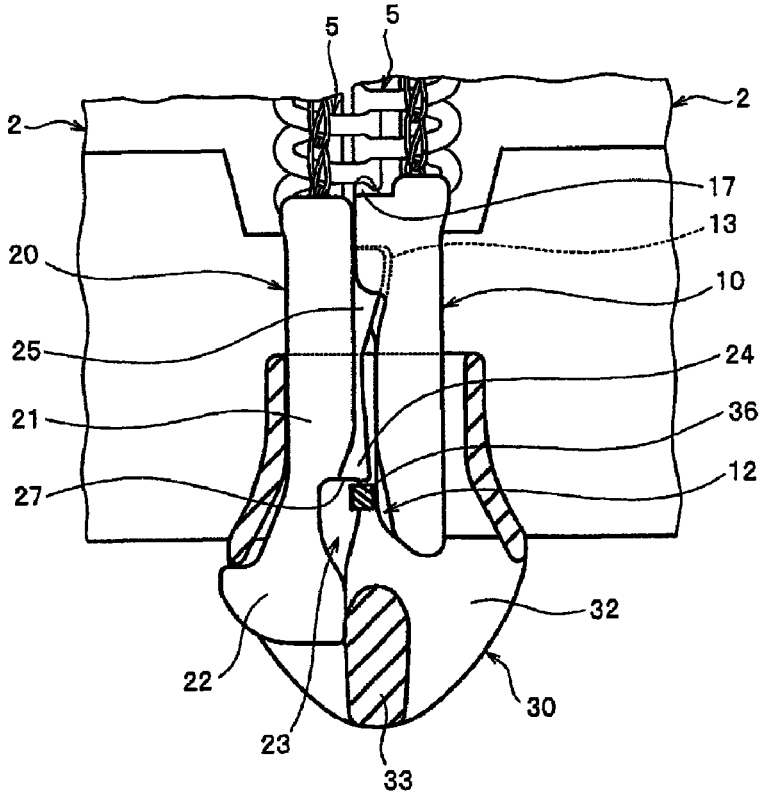
FIG. 10 is a main sectional view illustrating a state where the opening slider is allowed to be slid, so that left and right element rows are coupled.

In addition, the second notch portion 12 is formed in the area ranging from the position of the side which is closer to the element row 5 compared to the sectional surface 24*a* of the protrusion piece 24 toward the front end of the separable pin 10 in the length direction of the separable pin 10, for example, in the state where the separable pin 10 is completely inserted into the right side element guide lane of the reverse-opening slider 30, as described later (refer to FIG. 10).

The receiving concave portion 13 is formed so that the receiving concave portion 13 can receive the insertion piece 25 of the box pin 20 when the separable pin 10 is inserted into the reverse-opening slider 30. In addition, as described above, the upper plate portion 14 and the lower plate portion 15 are disposed on the upper surface side and the lower surface side of the receiving concave portion 13.

Therefore, when the insertion piece 25 of the box pin 20 is received in the receiving concave portion 13, the insertion piece 25 is overlapped with the upper plate portion 14 and the lower plate portion 15 in the up-down directions, so that the insertion piece 25 can be supported by the upper and lower plate portions 14 and 15. Accordingly, for example, when the left and right element rows 5 are coupled with each other, although a thrust force in the tape front-rear direction (up-down direction) is exerted on the box pin 20 and the separable pin 10, it is possible to prevent the positions of the box pin 20 and the separable pin 10 from being shifted in the up-down direction, so that it is possible to stably maintain the position relationship between the box pin 20 and the separable pin 10.

In addition, in the separable pin 10, the upper plate portion 14 disposed on the upper surface side of the receiving concave portion 13 is formed so that a portion of the upper plate portion 14 on the separable pin front end side is removed so as to easily insert the insertion piece 25 of the box pin 20 into the receiving concave portion 13.

The stepped portion 16 of the separable pin 10 is formed in a step shape having a size of capable of introducing the coupling head of the element 4 adjacent to the box pin 20 of the left-side fastener stringer 2 when the left and right element rows 5 are coupled with each other. In addition, the protrusion 17 is formed to protrude from the sectional surface of the stepped portion 16 on the side of the box pin 20 toward the element row 5 in the tape length direction (forward-backward direction) so as to be engaged with the element 4 adjacent to the box pin 20.

Next, in the separable bottom end stop 1 according to the aforementioned embodiment, manipulations at the time of coupling the separated left and right element rows 5 will be described with reference to FIGS. 4 to 10.

In the case of coupling the left and right element rows 5, first, the reverse-opening slider 30 and the opening slider 40 are allowed to be slid to the end portion on the side of the box pin 20 along the element row 5 of the fastener stringer 2 on the side where the box pin 20 is attached.

Figure 4:
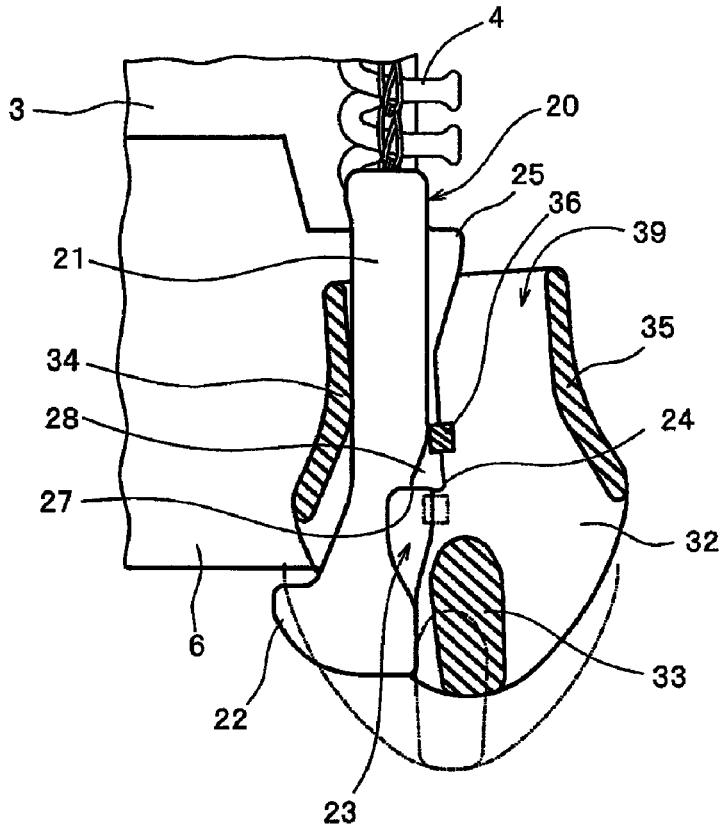
FIG. 4 is a main sectional view for explaining a state where a reverse-opening slider is allowed to be slid to a box pin side end portion.
Figure 5:
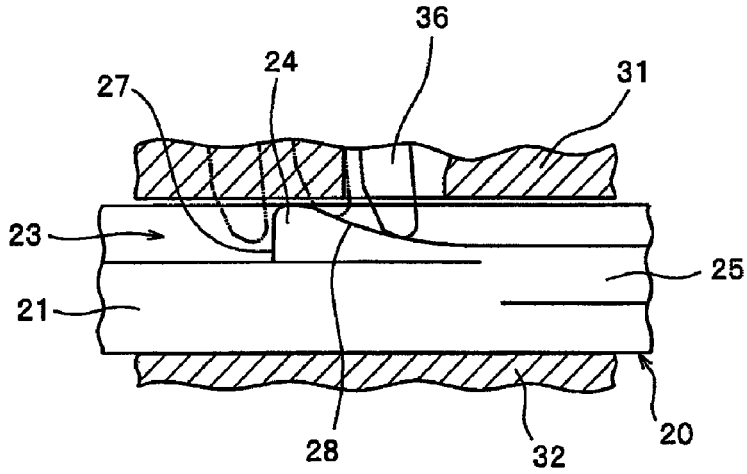
FIG. 5 is a main sectional view for explaining a movement of a locking pawl end portion when the reverse-opening slider is allowed to be slid to the box pin side end portion.

Initially, as illustrated in FIGS. 4 and 5, by sliding the reverse-opening slider 30 to the box pin side end portion, the box pin 20 is relatively inserted into the left side element guide lane 39 of the reverse-opening slider 30. At this time, since the locking pawl 36 of the reverse-opening slider 30 is disposed close to the left side element guide lane 39, if the box pin 20 is inserted into the element guide lane 39, the locking pawl 36 passes from the upper surface of the insertion piece 25 through the slant surface 28, which is formed on the box pin body 21 and the protrusion piece 24, to be guided to the first notch portion 23 of the box pin 20.

Therefore, the front end portion of the locking pawl 36 smoothly passes on the upper surface of the insertion piece 25 which is disposed at a position lower than the upper surface of the box pin body 21. After that, the front end portion proceeds to the slant surface 28, which is formed to be continuous with the upper surface of the insertion piece 25, and gradually rises by using the slope of the slant surface 28 to move to the first notch portion 23 (refer to FIG. 5). Therefore, it is possible to prevent the problem in that, when the box pin 20 is inserted into the reverse-opening slider 30, the front end portion of the locking pawl 36 is hooked due to the interference with the box pin body 21, so that it is possible to smoothly move the locking pawl 36 into the first notch portion 23.

In addition, in the reverse-opening slider 30 according to the invention, the element guide lane 39 is formed in a substantially Y shape. Therefore, as described above, since the box pin 20 is inserted into the Y-shaped element guide lane 39 when the reverse-opening slider 30 is slid to the box pin side end portion, the reverse-opening slider 30 is moved to the box pin side end portion after the posture of the slider 30 is allowed to be slightly slanted once in the counterclockwise direction during the passing through the box pin 20 and the slider 30 returns from the slanted posture in the clockwise direction, as illustrated in FIG. 4.

In this manner, in the case where the posture of the slider 30 is slanted during the moving of the reverse-opening slider 30 to the box pin side end portion, since the position of the locking pawl 36 of the reverse-opening slider 30 with respect to the box pin 20 is relatively shifted leftwards, there is a problem in that the front end portion of the locking pawl 36 may easily collide with the wall surface which is formed by the slant surface 28 of the box pin body 21, so that the sliding ability of the reverse-opening slider 30 may be deteriorated.

Therefore, in the embodiment, the slant surface 28 included in the box pin 20 is formed so that the dimension thereof in the tape width direction is gradually increased toward the locking plane 27. In this manner, since the dimension of the slant surface 28 in the tape width direction is gradually increased toward the locking plane 27, even if the posture of the slider 30 is slanted during the moving of the reverse-opening slider 30 to the box pin side end portion, it is possible to prevent the front end portion of the locking pawl 36 from colliding with the wall surface of the box pin body 21, so that it is possible to prevent the sliding ability of the reverse-opening slider 30 from being deteriorated.

Subsequently, after the reverse-opening slider 30 is slid to the box pin side end portion, the opening slider 40 is slid toward the box pin side end portion, to the position where the rear opening of the opening slider 40 and the rear opening of the reverse-opening slider 30 collide with each other.

Figure 6:
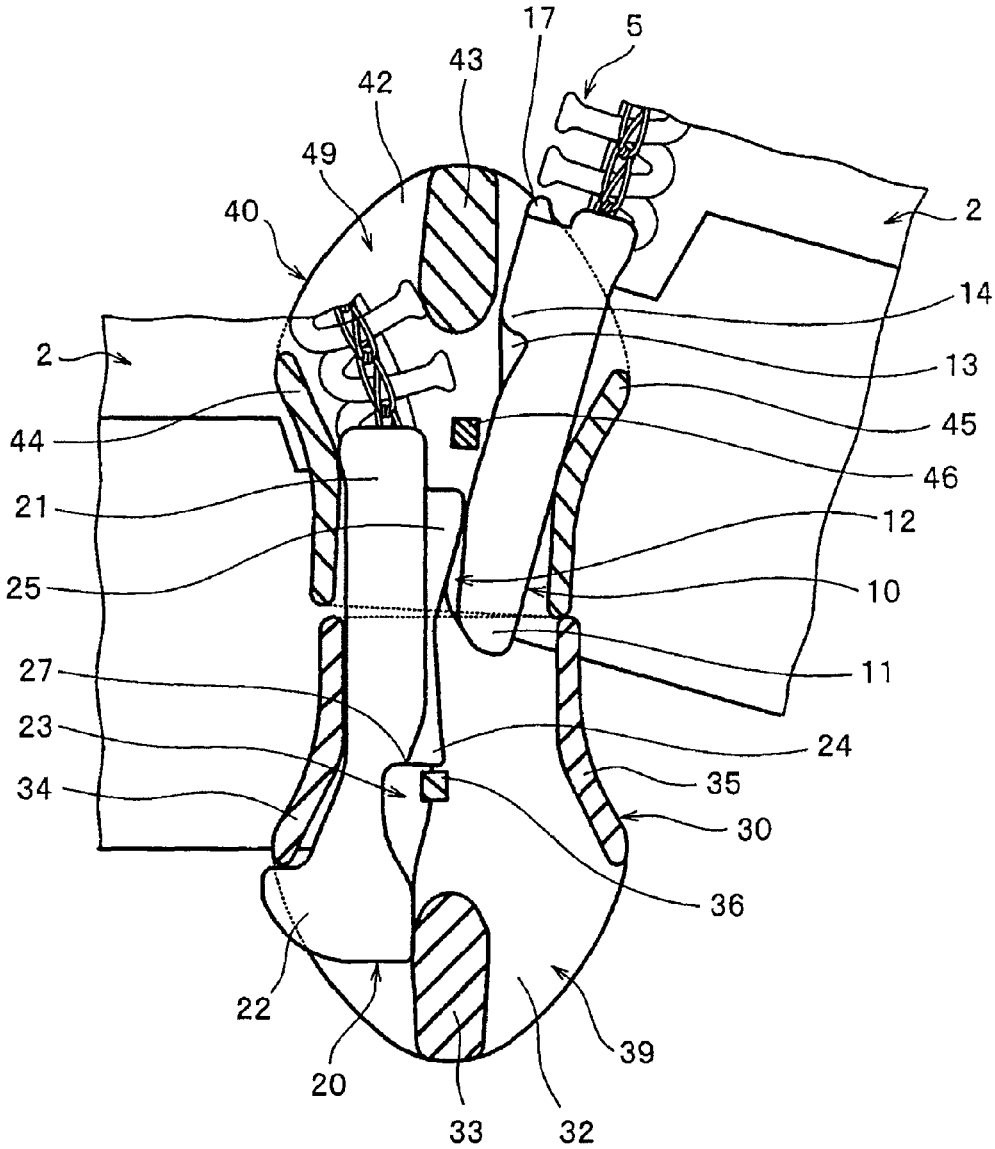
FIG. 6 is a main sectional view for explaining a state where the separable pin is inserted from a shoulder opening of an opening slider.
Figure 7:
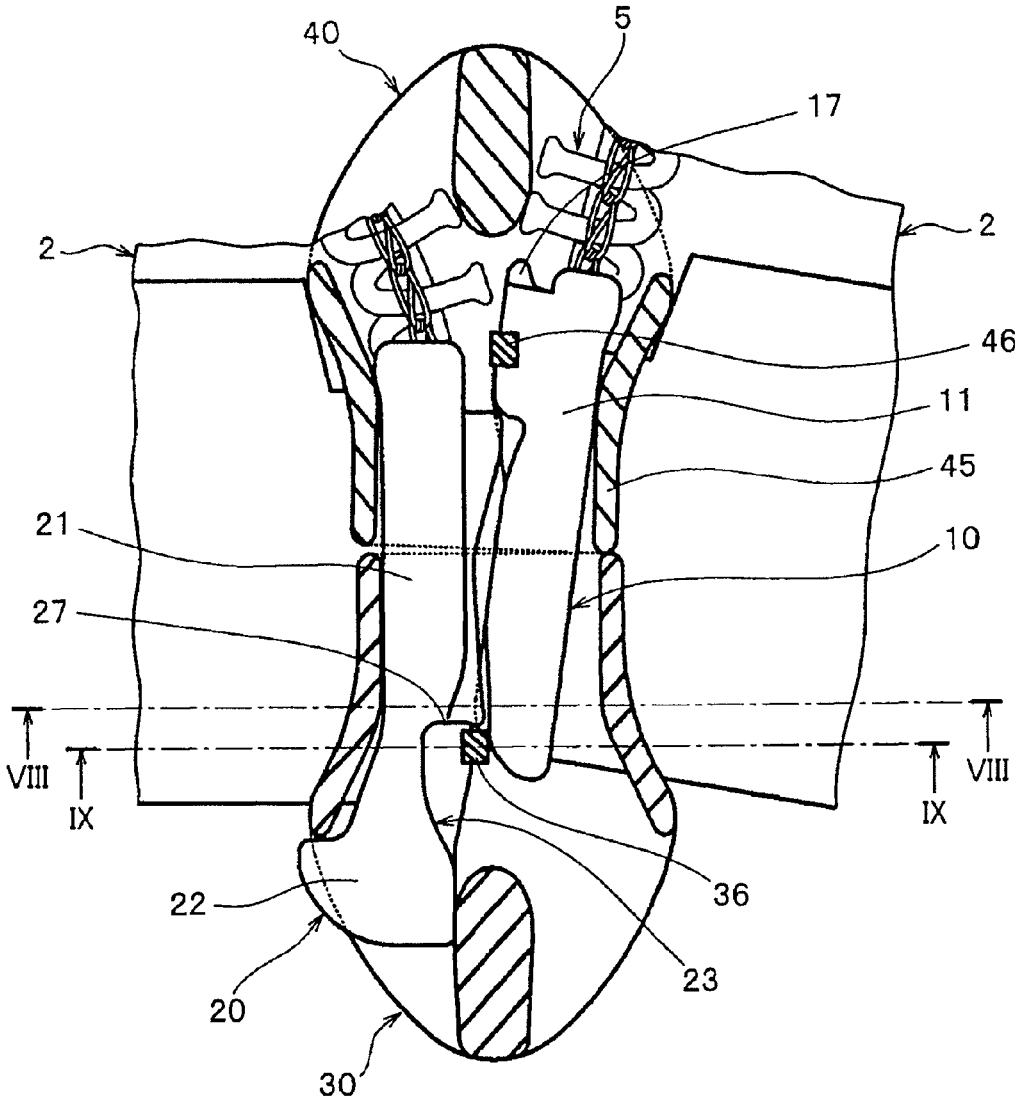
FIG. 7 is a main sectional view for explaining a state where the separable pin is inserted into a right side element guide lane of the reverse-opening slider.

Next, after the opening slider 40 is slid to a predetermined position, the separable pin 10 which is attached to the right side fastener stringer 2 is inserted from the right side shoulder opening of the opening slider 40 toward the right side element guide lane 39 of the reverse-opening slider 30 as illustrated in FIGS. 6 and 7. Therefore, without interference with the locking pawl 46, the front end portion of the separable pin 10 passes through the space between the insertion piece 25 of the box pin 20 and the right side flange 45 in the opening slider 40 to be introduced into the right side element guide lane 39 of the reverse-opening slider 30 (refer to FIG. 6).

In addition, the front end portion of the separable pin 10 which is introduced into the right side element guide lane 39 passes through the space between the box pin 20 and the right side flange 35 in the reverse-opening slider 30. At this time, since the protrusion piece 24 which protrudes in the tape width direction is disposed on the separable pin facing surface 26 of the box pin 20, the interval between the box pin 20 and the right side flange 35 in the reverse-opening slider 30 is decreased in comparison with the conventional case.

Figure 8:
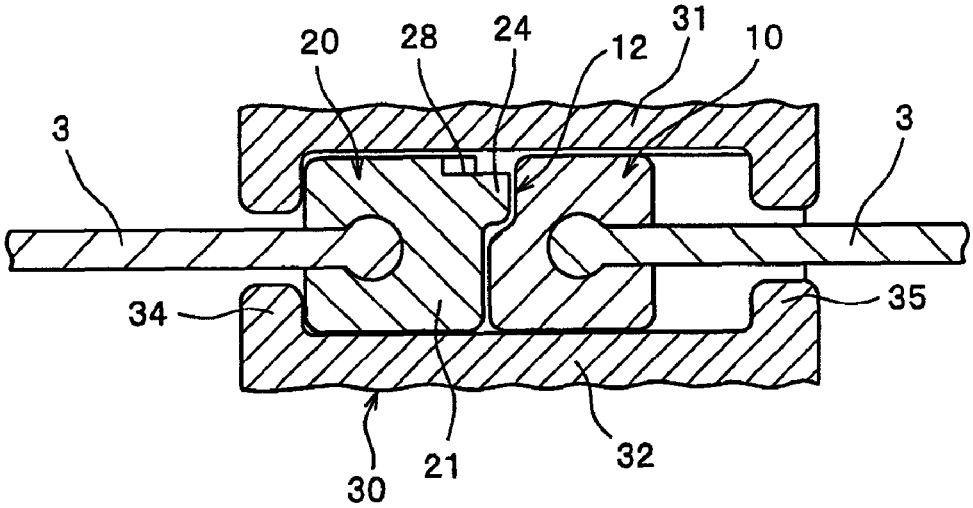
FIG. 8 is a sectional view taken along line VIII-VIII of FIG. 7.
Figure 9:
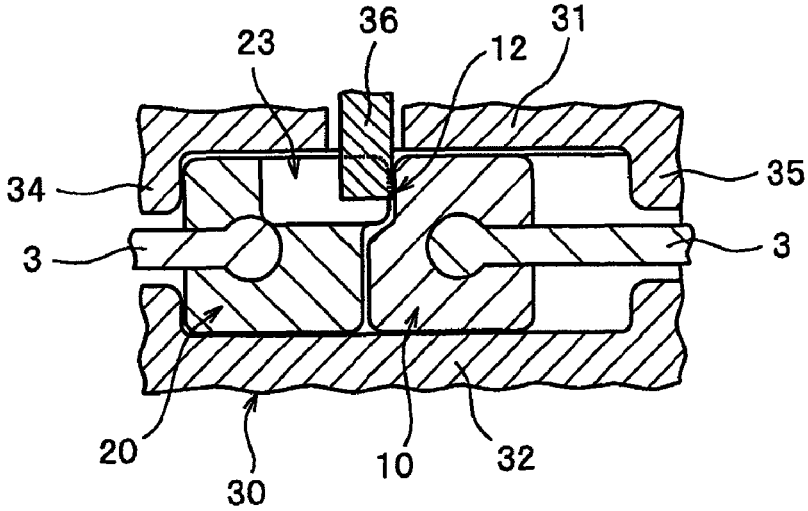
FIG. 9 is a sectional view taken along line IX-IX of FIG. 7

However, in the embodiment, the protrusion piece 24 is disposed on only the upper surface side of the separable pin facing surface 26 but not on the lower surface side, and the second notch portion 12 is formed in a partial area of the upper surface of the front end portion side of the separable pin 10. Therefore, it is possible to avoid the separable pin 10 from colliding with the protrusion piece 24 by the second notch portion 12, so that it is possible to smoothly insert the separable pin 10 into the right side element guide lane 39 of the reverse-opening slider 30 without interference with the protrusion piece 24 as illustrated in FIG. 8 and without interference with the front end portion of the locking pawl 36 as illustrated in FIG. 9.

Subsequently, the separable pin 10 is inserted into the right side element guide lane 39 of the reverse-opening slider 30 to the position where the insertion piece 25 of the box pin 20 is received in the receiving concave portion 13 of the separable pin 10. As a result, the manipulation of inserting the separable pin 10 is completed.

Next, after the separable pin 10 is sufficiently inserted into the right side element guide lane 39, the opening slider 40 is slid along the element rows 5 toward the top stoppers 7. Therefore, as illustrated in FIG. 10, the protrusion 17 of the separable pin 10 is engaged with the element 4 adjacent to the box pin 20 of the left-side fastener stringer 2, and the left and right element rows 5 are coupled with each other, so that the slide fastener 1 can be closed.

At this time, the locking pawl 36 of the reverse-opening slider 30 is received in the first notch portion 23 of the box pin 20. In addition, in the reverse-opening slider 30, the locking plane 27 which is wider in the tape width direction than that of the conventional separable bottom end stop 1 is constructed with the first side wall surface 23*b* of the first notch portion 23 and the sectional surface 24*a* of the protrusion piece 24 on the box pin front end side.

Therefore, by contacting the front end portion of the locking pawl 36 with the locking plane 27, it is possible to prevent the reverse-opening slider 30 from freely moving from the box pin side end portion without an intentional sliding manipulation. In addition, even if the reverse-opening slider 30 is shaken so that the position of front end portion of the locking pawl 36 moves in the left-right direction, since the locking plane 27 is formed so as to be wide in the tape width direction, the state where the front end portion of the locking pawl 36 is in contact with the locking plane 27 can be stably maintained.

Accordingly, it is possible to prevent the occurrence of the problem of the conventional separable bottom end stop occurring when the reverse-opening slider 30 is shaken, that is, the problem in that the position of the front end portion of the locking pawl 36 moves relatively to the gap between the box pin 20 and the separable pin 10. Therefore, it is possible to effectively prevent the left and right element rows 5 from being unintentionally separated from each other.

Figure 11:
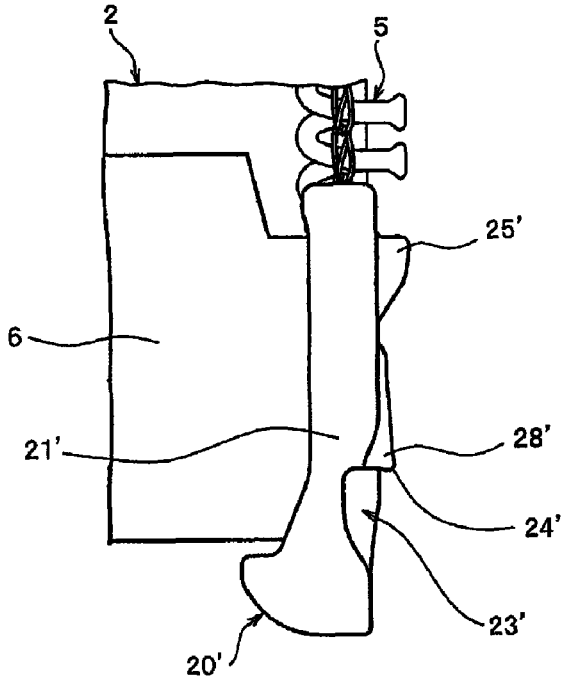
FIG. 11 is an enlarged main view illustrating a box pin in a modified example of the separable bottom end stop according to the invention.
Figure 12:
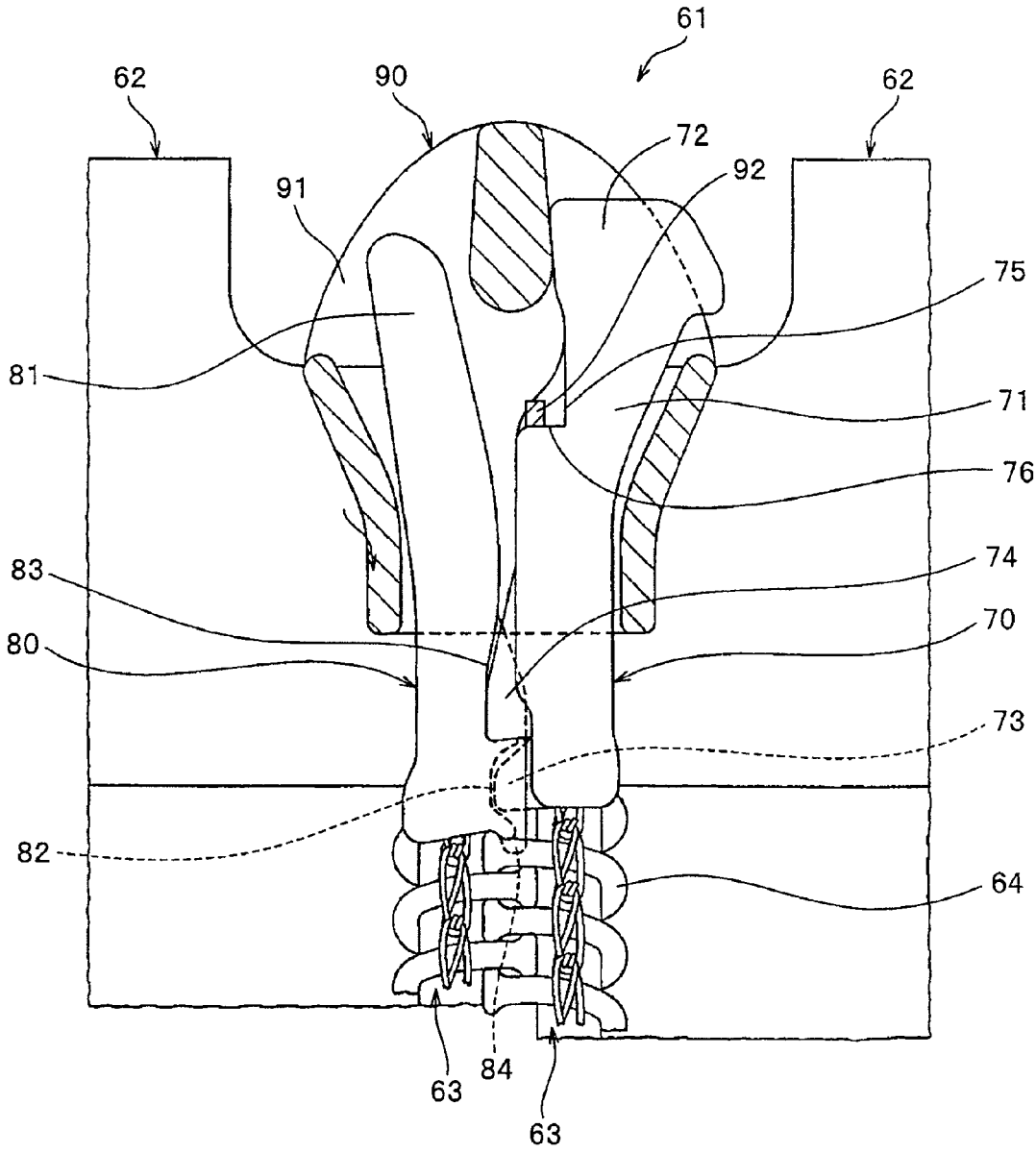
FIG. 12 is a main sectional view illustrating a left insertion type reverse-opening separable bottom end stop used for a conventional slide fastener.

In addition, in the separable bottom end stop 1 according to the aforementioned embodiment, in the box pin 20, although the slant surface 28 formed in the box pin body 21 and the protrusion piece 24 is formed to be continuous with the upper surface of the insertion piece 25, the invention is not limited thereto. For example, as illustrated in a modified example of FIG. 11, a slant surface 28' formed in a box pin body 21' and a protrusion piece 24' of a box pin 20' is not formed to be continuous with an upper surface of an insertion piece 25', but may be formed to be separated from each other.

In this manner, although the slant surface 28' and the upper surface of the insertion piece 25' are not formed to be continuous with each other, for example, if the height position of the element row side end portion of the slant surface 28' is set to substantially the same height position as that of the upper surface of the insertion piece 25', similarly to the separable bottom end stop 1 according to the aforementioned embodiment, it is possible to smoothly move the locking pawl 36 into the first notch portion 23' without occurrence of the problem in that, when the reverse-opening slider 30 is slid to the box pin side end portion of the element row, the front end portion of the locking pawl 36 is hooked by the box pin body 21'.

In addition, in the separable bottom end stop 1 according to the invention, it is preferable that the height from the lower surface of the box pin body 21 to the bottom surface 23*a* of the first notch portion 23 is equal to the height from the lower surface of the box pin body 21 to the end edge portion of the slant surface 28 on the side of the element row 5, or the height from the lower surface of the box pin body 21 to the end edge portion of the slant surface 28 on the side of the element row 5 is lower than the height from the lower surface of the box pin body 21 to the bottom surface 23*a* of the first notch portion 23.

In the relationship to the box pin 20, the front end of the locking pawl 36 of the reverse-opening slider 30 is located to be higher than the bottom surface 23*a* of the first notch portion 23, as illustrated in FIG. 5. Therefore, as described above, the height position of the end edge portion of the slant surface 28 on the side of the element row 5 is set to the height position which is equal to or lower than that of the bottom surface 23*a* of the first notch portion 23, so that it is possible to easily mount the front end of the locking pawl 36 on the slant surface 28 when the box pin 20 is inserted into the element guide lane 39 of the reverse-opening slider 30.

The invention claimed is:

1. A separable bottom end stop for a slide fastener, comprising:

a separable pin which is integrally formed in one end of an element row of one fastener stringer of a pair of left and right fastener stringers where element rows are formed in facing tape side edge portions of left and right fastener tapes; and a box pin which is integrally formed in one end of the element row of an other fastener stringer, wherein the box pin includes a box pin body, a first notch portion which is notched in a first surface of the box pin body from a side of a separable pin facing surface toward an inner portion of the box pin body so as to receive a front end portion of a locking pawl of a reverse-opening slider, a protrusion piece which protrudes from the separable pin facing surface of the box pin body toward a side of the separable pin in a tape width direction, wherein a side wall surface which is disposed to the first notch portion on a side of the element row and a sectional surface which is disposed to a box pin front end side of the protrusion piece are formed in one plane and constitute a locking plane which contacts with the front end portion of the locking pawl which is received in the first notch portion to stop the reverse-opening slider, wherein the box pin body and the protrusion piece are configured to have a slant surface (28, 28') which is downwardly slanted from a position of the locking plane toward the side of the element row on a tape surface side of the fastener tape so as to guide the locking pawl toward the first notch portion when the box pin is inserted into the reverse-opening slider, and wherein the reverse-opening slider passes through the element rows and the locking pawl can stop the reverse-opening slider with respect to the element rows on a side of an element guide lane into which the box pin is inserted.

2. The separable bottom end stop for the slide fastener according to claim 1, wherein the protrusion piece is disposed to a first surface side of the separable pin facing surface and a second notch portion is notched toward an inner portion of the separable pin in a box pin facing surface of the separable pin.

3. The separable bottom end stop for the slide fastener according claim 1, wherein the box pin includes an insertion piece which protrudes from the separable pin facing surface toward the side of the separable pin at a position which is closer to the side of the element row compared to the protrusion piece of the separable pin facing surface, the separable pin includes a receiving concave portion on the box pin facing surface, in which the receiving concave portion receives the insertion piece when the separable pin is inserted into the reverse-opening slider, and a first surface of the insertion piece and the slant surface are formed to be continuous with each other.

4. The separable bottom end stop for the slide fastener according to claim 2, wherein the box pin includes an insertion piece which protrudes from the separable pin facing surface toward the side of the separable pin at a position which is closer to the side of the element row compared to the protrusion piece of the separable pin facing surface, the separable pin includes a receiving concave portion on the box pin facing surface, in which the receiving concave portion receives the insertion piece when the separable pin is inserted into the reverse-opening slider, and a first surface of the insertion piece and the slant surface are formed to be continuous with each other.

* * * * *